United States Patent [19]

Hsieh

[11] Patent Number: 4,814,958

[45] Date of Patent: Mar. 21, 1989

[54] STRAIGHT TYPE FLUORESCENT LAMP DEVICE WITH LIGHT REFLECTING PLATES

[76] Inventor: Chen-Huang Hsieh, 22, Ping Ell Rd., Keelung, Taiwan

[21] Appl. No.: 146,815

[22] Filed: Jan. 22, 1988

[51] Int. Cl.[4] ..... F21S 3/02

[52] U.S. Cl. ..... 362/217; 362/277; 362/282; 362/283; 362/319

[58] Field of Search ..... 362/222, 223, 224, 225, 362/260, 277, 282, 283, 290, 292, 319, 322

[56] References Cited

U.S. PATENT DOCUMENTS

| | | | |
|---|---|---|---|
| 1,593,246 | 7/1926 | De Haven | 367/283 |
| 2,485,133 | 10/1949 | Behnke | 362/225 |
| 3,548,187 | 12/1970 | Kruger | 362/225 |
| 4,322,779 | 3/1982 | Böhme et al. | 362/283 |

FOREIGN PATENT DOCUMENTS

| | | | |
|---|---|---|---|
| 3316000 | 8/1984 | Fed. Rep. of Germany | 362/260 |
| 2315660 | 2/1977 | France | 362/224 |
| 334803 | 9/1930 | United Kingdom | 362/283 |

*Primary Examiner*—Ira S. Lazarus
*Assistant Examiner*—Sue Hagarman
*Attorney, Agent, or Firm*—Asian Pacific International Patent & Trademark Office

[57] ABSTRACT

The fluorescent lamp device has reflecting plates, its body is made by direct extrusion, and it can be cut into any desired length to match with straight-type fluorescent tubes of any length specification, and tube holders, one each at each end of the body of the device; by means of the attachment of light reflecting plates and glare-proof plates one can increase the intensity of downward straight light by 1.7 times and substantially preclude damage caused by glare of light.

7 Claims, 10 Drawing Sheets

STRAIGHT TYPE FLUORESCENT LAMP DEVICE WITH LIGHT REFLECTING PLATES

BACKGROUND OF THE INVENTION

The human life-style was changed with the invention of electric lights created by Thomas Edison. Before the invention, people made their living according to the time schedule arranged by the sun: to work at sunrise and to retire at sunset. After the invention of electric lights, people's living style has consequently not been limited by the environment and the time, and the electric light has been widely used at night. Accompanying the development of technology, hydraulic power generation and thermo-power generation provide people with convenient power supply. Consequently, people are continuously doing their efforts in the creation and development of home appliances and electric machinery. Furthermore, the success of the application of nuclear power generation provides people with more cheaper power supply. However, while seeking enjoyment, people are gradually neglecting to protect the window of their soulthe eyes. When a person is suffering from the obstruction of eyesight, he is just like the people who lived in the era before Thomas Edison and can not enjoy the result produced by electric power. It is regretable that there are some malfunctioned lamp devices which constantly damage our eyesight.

Except the circular type for decoration at home, conventional fluorenscent lamp devices for public places and factories are mainly of straight type fluorescent tubes The straight type fluorescent tubes, according to the length and the brightness, have five different specifications: 40 W, 30 W, 20 W, 15 W and 10 W and 4 ft., 3 ft., 2 ft., 1.5 ft. and 1 ft. respectively. In order to fit these five specifications, the lamp devices are designed in five different specifications. It is not economic to produce five different lamp devices for said different fluorescent tubes. To meet FMS (flexible manufacturing system) will waste a lot of time in the change of molds.

Conventional lamp devices are easy to produce a problem of glaring. Expecially in the lighting intensive area, the problem of glaring is worse. Watching the fluorescent lamps directly or the glare produced by the rays of non-parallel lightings may affect working efficiency and the motion or even threaten working safty and cause opthalmic diseases. Currently, various large scale domestic lamp devices manufacturers have been investing large amount of capital in the study and the production of glare-proof lamp devices. There are now glare-proof lamp devices available in the market, but the price of these is high, the assembly is difficult, and the size of which is huge.

Straight type fluorescent tubes have an outer appearance of round tubular shape which radiate lights axially. Conventional fluorescent lamps radiate lights through the lower area of the horizontal axis of the fluorescent tubes, and the lights through the upper area of which are reflected by lamp shade. Because the conventional fluorescent lamps are used for open spaces where dust and ashes are easy to cumulate to decrease the diaphaneity of the tubes and to lower the effect of the tubes. In high dust-prone area such as factories, schools, and shops and residences over the street, if there is no air conditioner, and the quality of lighting is usually very poor.

SUMMARY

The main character of the present invention is a lamp body with a reflecting plate made of aluminum squeezed in rectangular shape which can be cut into different length to fit different specifications of fluorescent tubes without changing the mold so as to drastically reduce the manufacturing cost.

Another character of the present invention is the reflecting plate which can be adjusted for any angle to efficiently reflect the lights of the fluorescent tubes so as to strengthenn the applicability of the lamps.

Another character of the invention is that the lamp body and the lamp shade combine to form an air-tight space to prevent the cumulation of dust. Because the heat produced by the lamp itself is limited, it does not cause poor effects.

Another character of the invention is that it is feasible to connect several pieces of the present lamp devices in parallel or in series for use in the area where requiring high brightness.

A yet further character of the present invention is that the stabilizer is separately supplied, which can be directly attached to the lamp body and can also be separately fixed onto the ceiling. Since the stabilizer is not a fixed type, the type of which can be selected to meet different requirements.

Figure 10:
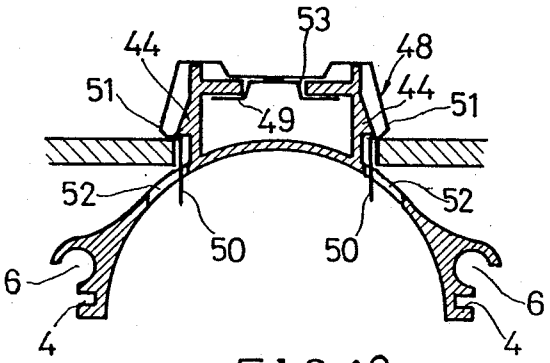

FIG. **8*a* is a perspective view of a clamp for the second preferred embodiment, this FIG. is located on the sheet with FIG. 10**.

FIG. **8*b* is a perspective view of a clamp for the second preferred embodiment, which extends over two lamp device bodies, this FIG. is located on the sheet with FIG. 10**.

Figure 9A:
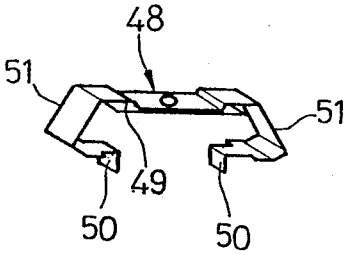
Figure 9:
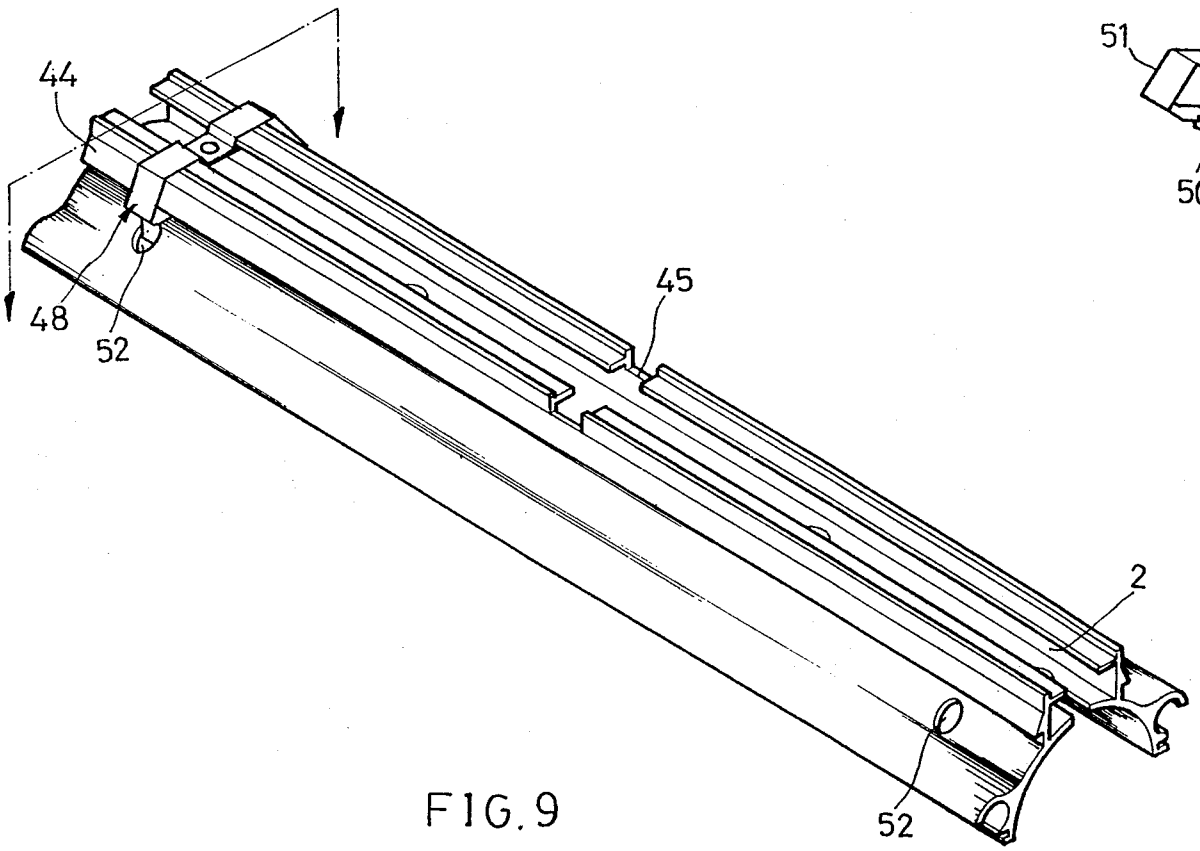

FIG. 9 is a perspective view of a third preferred embodiment for the present invention.

FIG. **9*a*** illustrates a clamping device for the third preferred embodiment.

FIG. 10 is a cross sectional view of the line AA of the third preferred embodiment when fixed to ceiling.

FIG. **10*a* illustrates a motion of the preferred embodiment taken from FIG. 10** when it is dismounted.

DETAILED DESCRIPTION OF THE PREFERRED EMBODIMENTS

Figure 1:
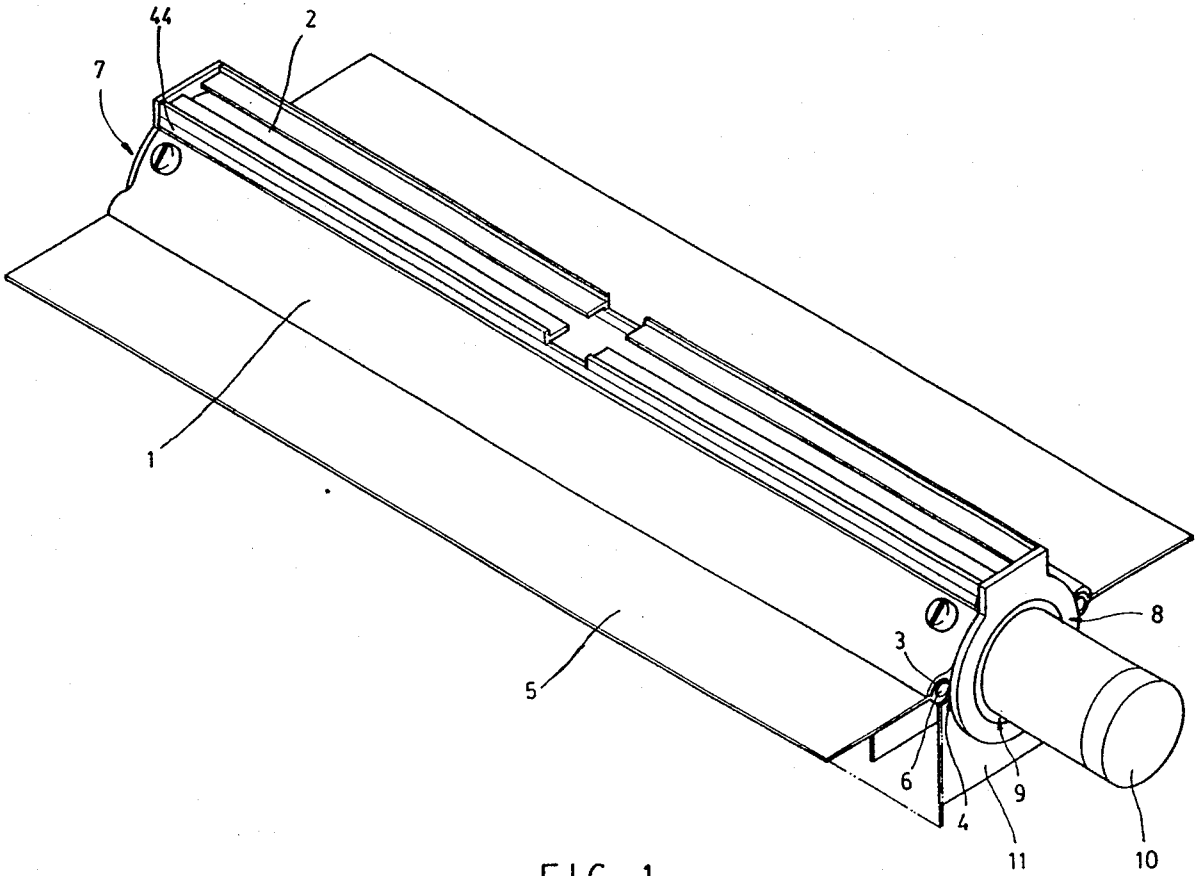
FIG. 1 is a perspective top view of a lamp device embodying the present invention.

According to the perspective view of the first preferred embodiment as shown in FIG. 1, the body 1 of the lamp device is a semi-circle formed by direct squeezing, the inner side of which is treated for presenting a glossy surface to strengthen the reflecting effect, the upper part is a groove 2 to reinforce the structure of the body 1 and to conceal electric wires and the central part of which is an opening 45 (FIG. 9) for the fixation of electric wires while several pieces of lamp devices are connected in series. The semi-circle of the body 1 has bilaterally a round opening 3 (FIG. 6) and a retaining groove 4, said round opening 3 is for the fixation of the round flange 6 of reflecting plate 5, said round flange 6 is a hollow body having an eccentric, round groove to allow the reflecting plate 5 to be freely adjusted to any position from horizontal to vertical direction and to stay at any angle adjusted. Said retaining groove 4 is for the fixation of glare-proof plates 11. The number of glare-proof plates can be adjusted according to respective requirements. Hook-shaped flanges 44 are arranged bilaterally to match with the clamps 40 as shown in FIG. 9*a*. Two tube holders 7, 8 are respectively arranged at both ends of the lamp body 1. One of the tube holders 8 has a starter holder 9 for receiving starter 10.

Figure 2:
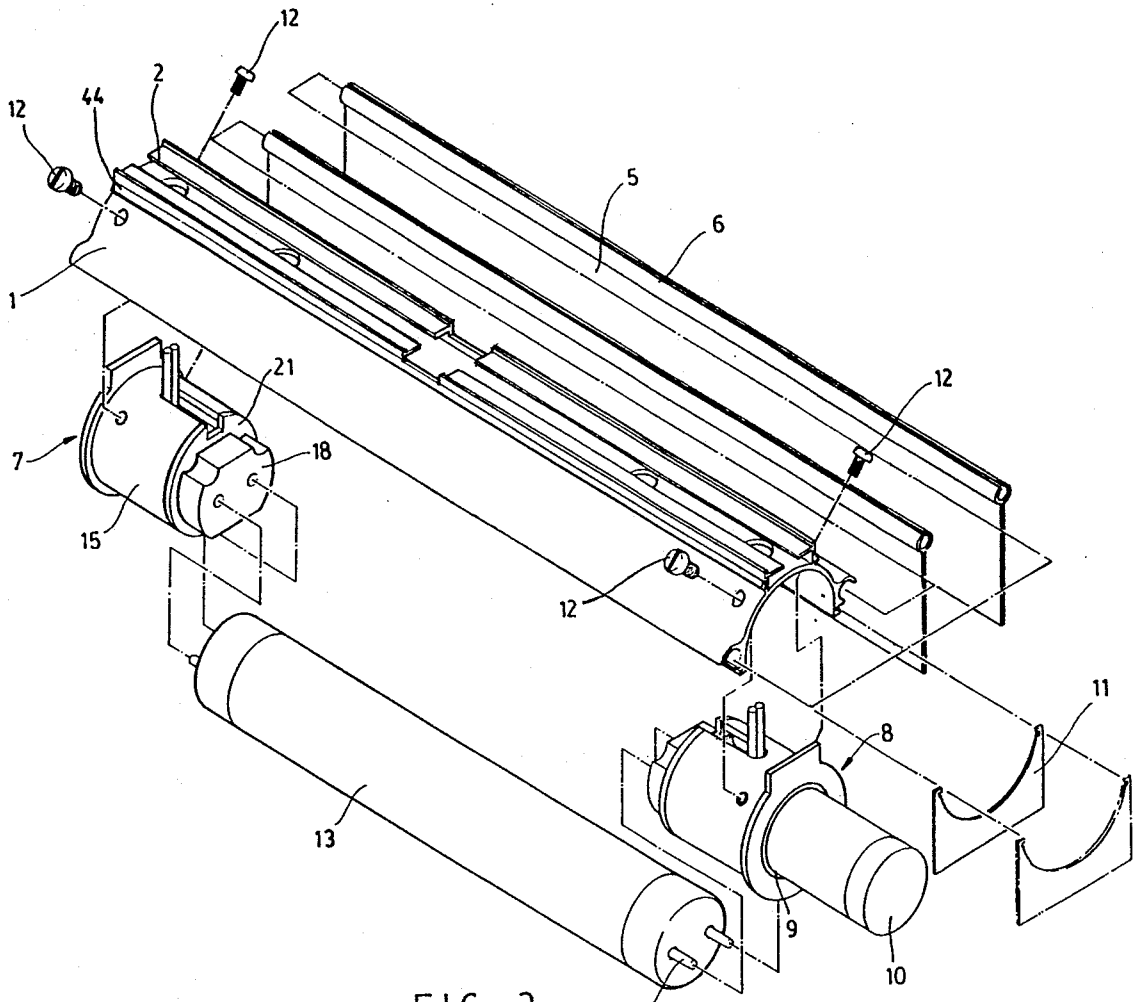
FIG. 2 is an top view of an assembly drawing of the preferred embodiment.

Please refer to the assembly drawing of the preferred embodiment as shown in FIG. 2, the lamp device body 1 is a semi-circle which has bilaterally a respective round opening 3 and a retaining groove 4, the round opening 3 is to closely match with the round flange 6 of reflecting plate 5, the retaining groove 4 is for a transparent or translucent lamp shade or for glare-proof plates 11 to be fixed thereto; two tube holders 7, 8 are set respectively on both ends and firmly fixed with bolts 12; tube holder 8 is attached with a starter holder 9 for a starter 10 ; tube holders 7, 8 are for the connection of fluorescent tube 13 through power connection legs 14 so as to supply electricity to the tube for light emitting.

Figure 3:
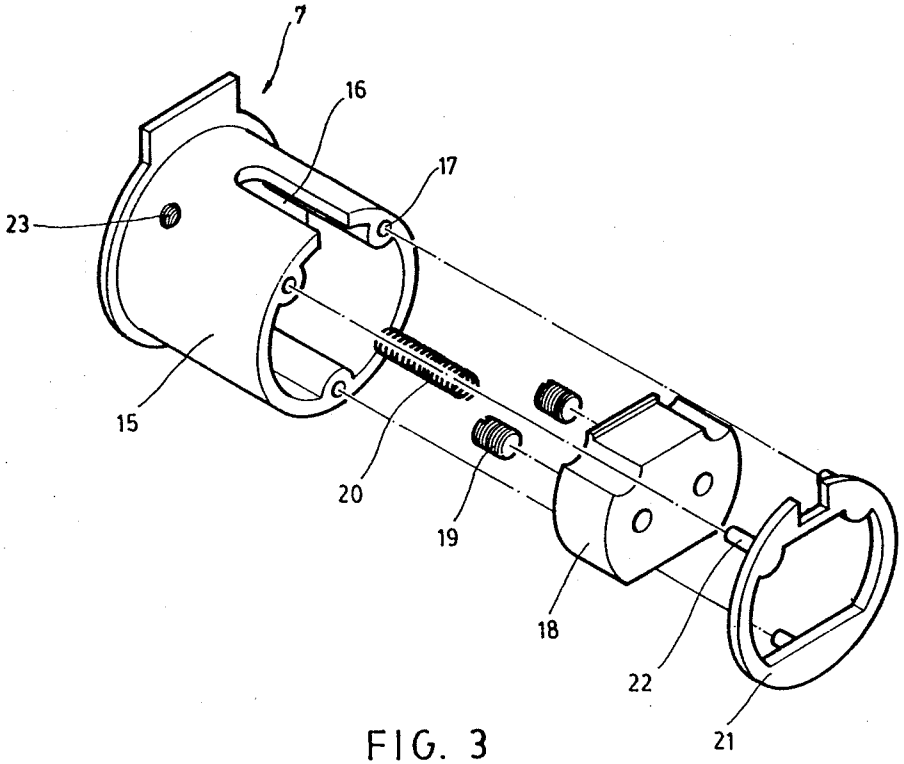
FIG. 3 is an assembly drawing of a tube holder for the preferred embodiment.

Please refer to the assembly drawing of the tube holder for the preferred embodiment as shown in FIG. 3, the outer sleeve 15 of tube holder 7 is a cylindric shape, having a slot 16 on the top for electric wires to move thereabout and two bolt holes 23 for bolts 12 to screw it up onto lamp device. The outer sleeve 15 comprises interiorly on the periphery three pin holes 17 for the three plug pins 22 of the round stop plate 21 to respectively plug therein so as to hold a lamp socket 18 inside the outer sleeve 15. The lamp socket 18 is screwed up with two pieces of bolts 19 on the back side for the location of electric wire which connects with the connection legs 14 of the fluorescent tube 13, wherein a spring 20 is placed inside the outer sleeve 15 to push the lamp socket 18 outward and to allow the lamp socket to move upward and down-ward. The lamp socket 18 has two holes on the font to match with the bolts 19 for the connection legs 14 to respectively plug in.

Figure 4:
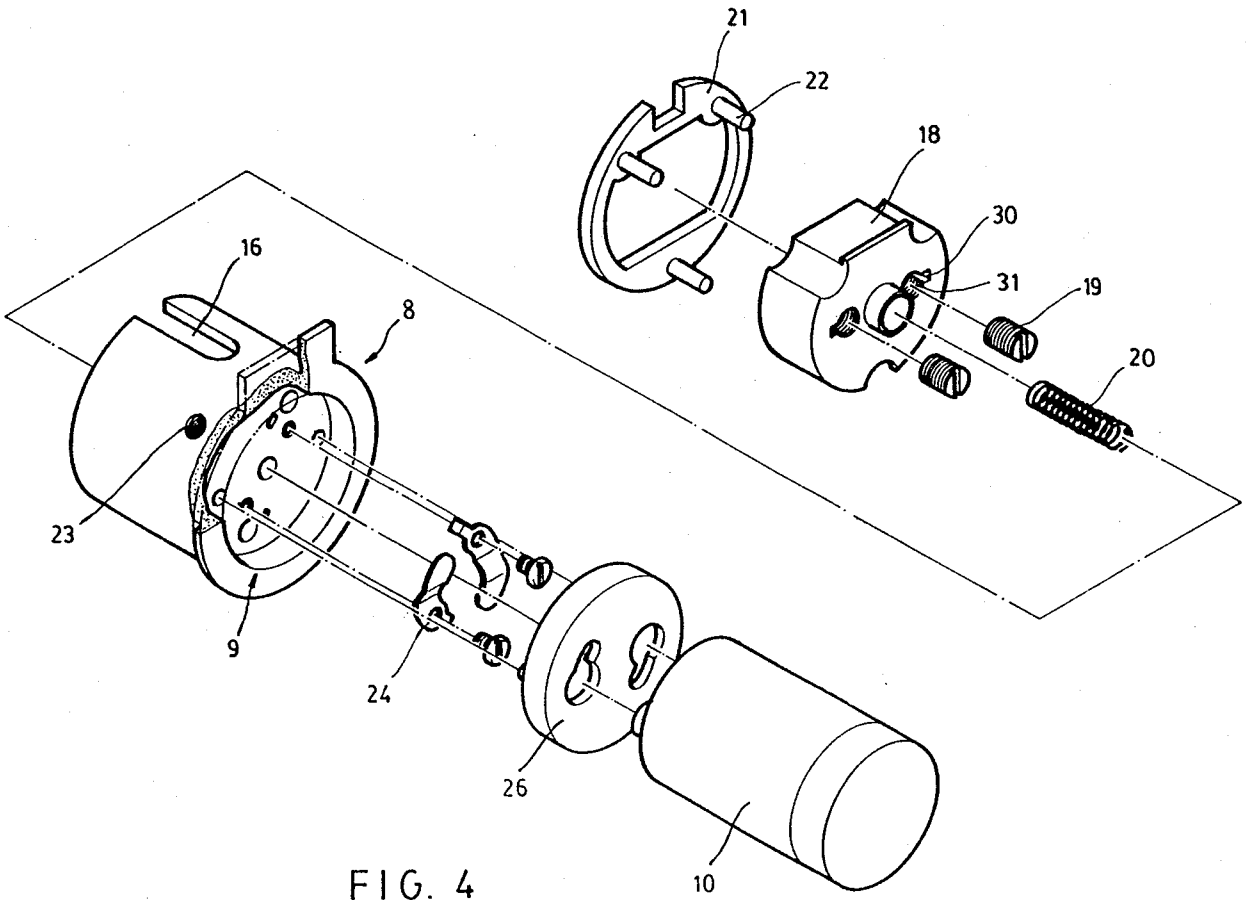
FIG. 4 is an assembly drawing of an auxiliary starter holder for the tube holder of the preferred embodiment.

Please refer to the assembly drawing of the auxiliary starter holder for the tube holder of the preferred embodiment as shown in FIG. 4, the outer sleeve 15, spring 20, lamp socket 18, bolts 19 and stop plate 21 are same as shown in FIG. 3. The lamp socket has a dent holder 30 in the center for the location of the spring 20 at one end and one bolt hole 31 each on both sides of the dent holder 30, each bolt hole 31 comprising a retaining cutting 32 on outer side, a bare wire is placed inside each retaining cutting 32 of the bolt holes 31 and screwed with bolts 19 for power supply through the connection legs 14 of fluorescent tube 13 so as to let the fluorescent tube 13 emit light; the fluorescent tube 13 is firmly located by means of the pushing force of the spring 20 to push the lamp socket 18 against connection legs 14. The outer sleeve 15 comprises two spring leaves 24 on the other end and tightly fixed respectively by bolts 25 and then covered with a cover plate for starter holder 26 so as to allow the starter 10 to be fixed thereto. The spring leaves 24 are of flat type with respective ends turning upward to strengthen their spring force and to prevent the starter 10 from loosening that may cause a poor condition of contact.

Figure 5:
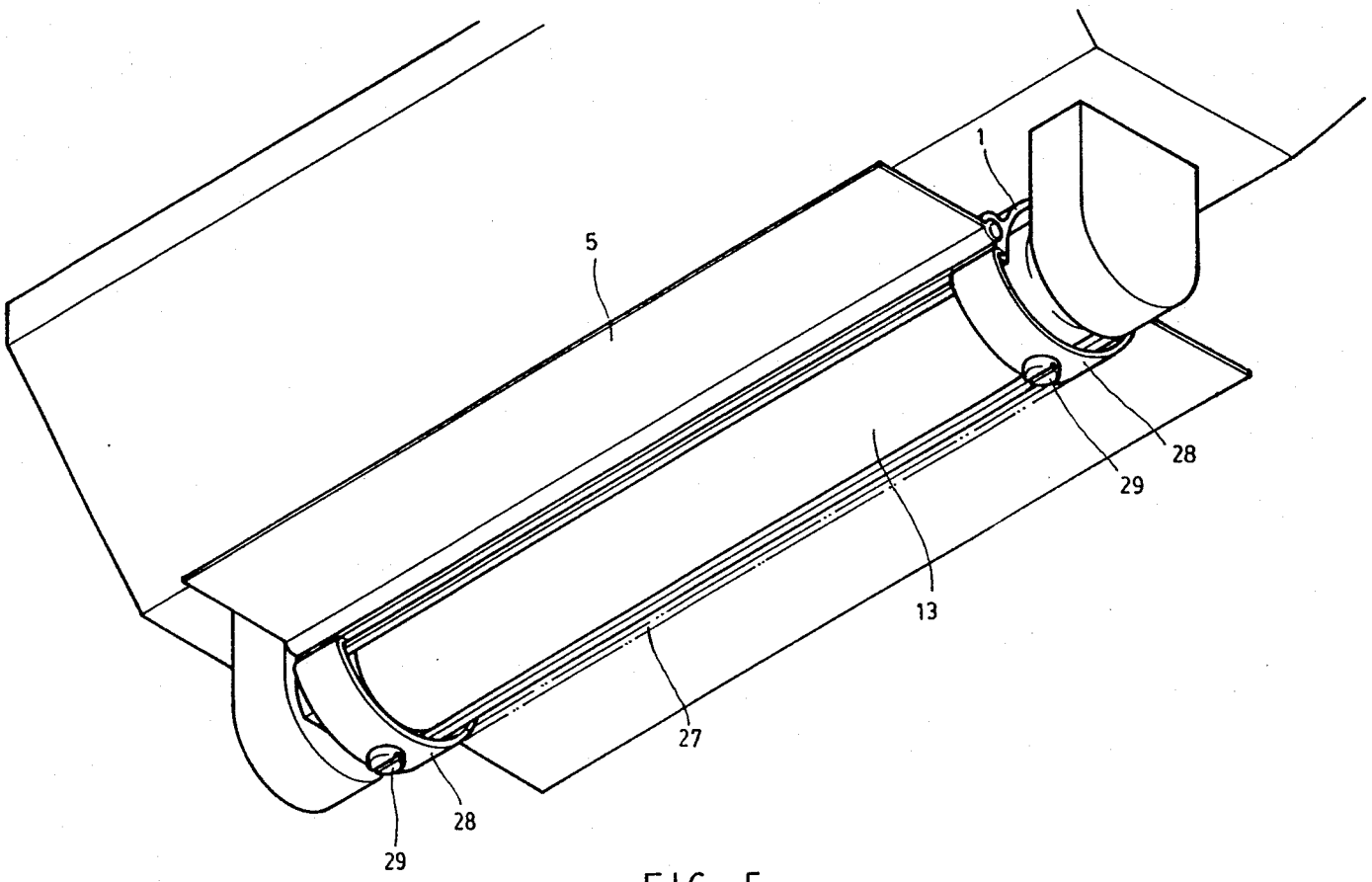
FIG. 5 is a perspective view of the preferred embodiment attached to a conventional lamp device.

According to the perspective view of the preferred embodiment attached to a conventional lamp device as shown in FIG. 5, the present invention can make use of conventional lamp device to match together so as to improve the shortcomings of a conventional device, wherein the fluorescent tube 13 is covered with a transparent or translucent lamp shade 27 to protect it against dust and said lamp shade 27 is fixed by locating plates 28 on both ends.

Figure 6:
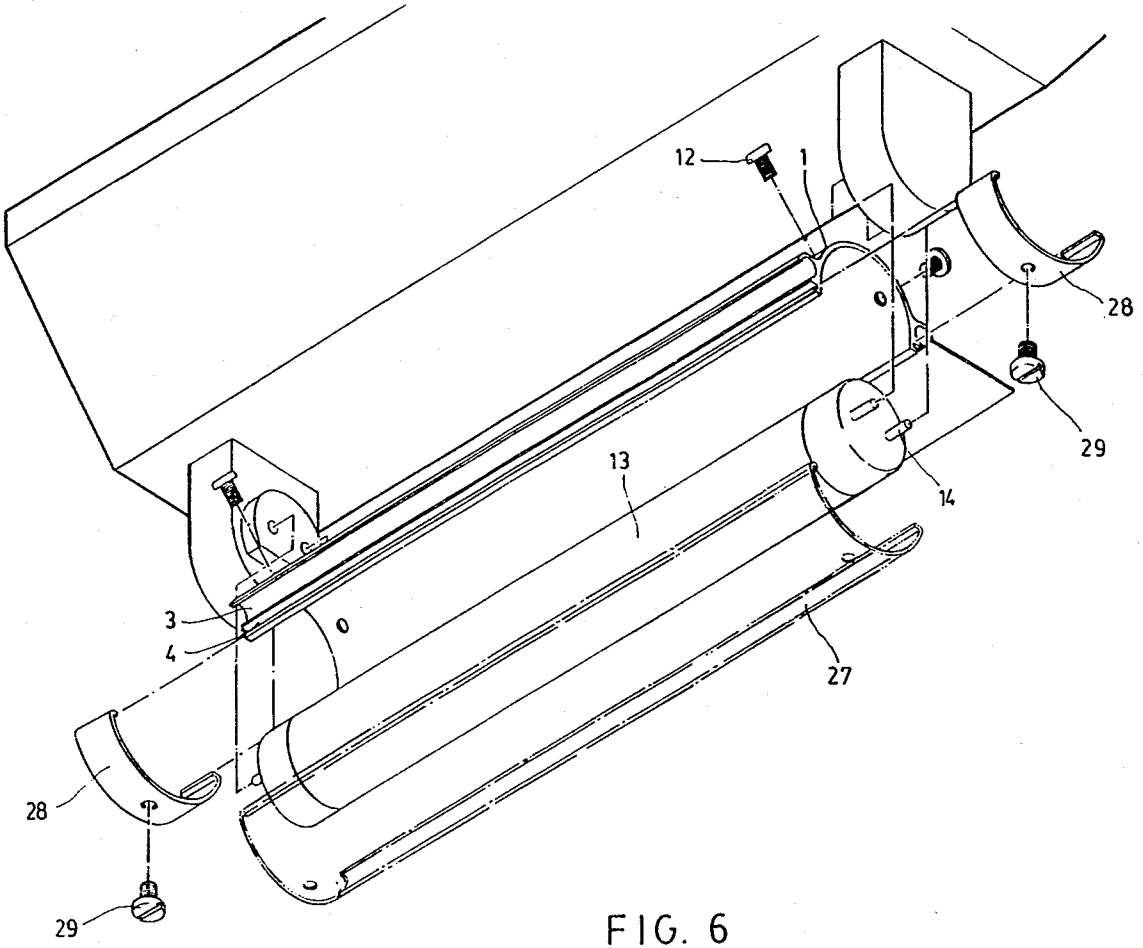
FIG. 6 is an assembly drawing of the preferred embodiment attached to a conventional lamp device.

Please refer to the assembly drawing of the preferred embodiment attached to a conventional lamp device as shown in FIG. 6, the distance between the body of lamp device 1 and fluorescent tube 13 is approximately 1–2 mm. It is very simple to install the device by coverting a lamp shade 27 with locating plates 28 to fix them together.

Figure 7:
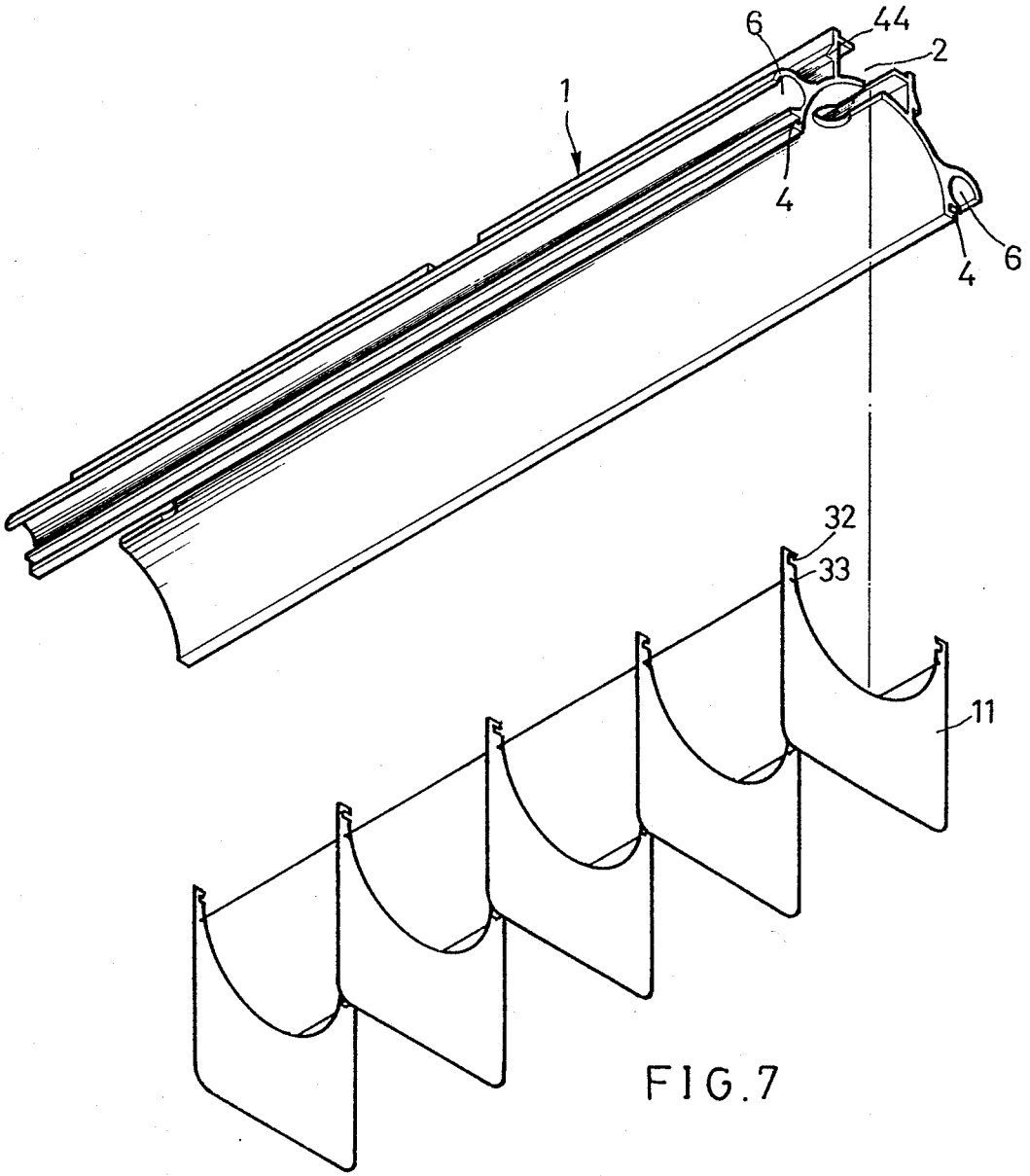
FIG. 7 is a bottom view of an assembly drawing of the preferred embodiment with glare-proof plates.

Please refer to the assembly drawing of the preferred embodiment attached with glare-proof plates as shown in FIG. 7, each of said glare-proof plates 11 is in rectangular shape, made of transparent or translucent material, comprising a semi-circular cutting, each semi-circular cutting comprises respectively a retaining cutting 32 and a line gap 33 on both ends for two pieces of soft wire lines to insert into each line gap 33 so as to connect all glare-proof plates 11 in series and in equal interval of distance for easy storage, installation and disamounting and to let the glare-proof plates by attached to the retaining groove 4 at any position but will not be displaced due to the blowing of wind. When a fluorescent tube, is to be replaced, one only has to move the glare-proof plates 11 from one end to the other end letting them be squeezed together, after the tube is replaced, one needs only to catch the first piece of glare-proof plate 11 and move it back to original position along the retaining groove 4 and all the glare-proof plates 11 and are well arranged in equal interval of distance to perform their glare-proof effect.

Figure 8:
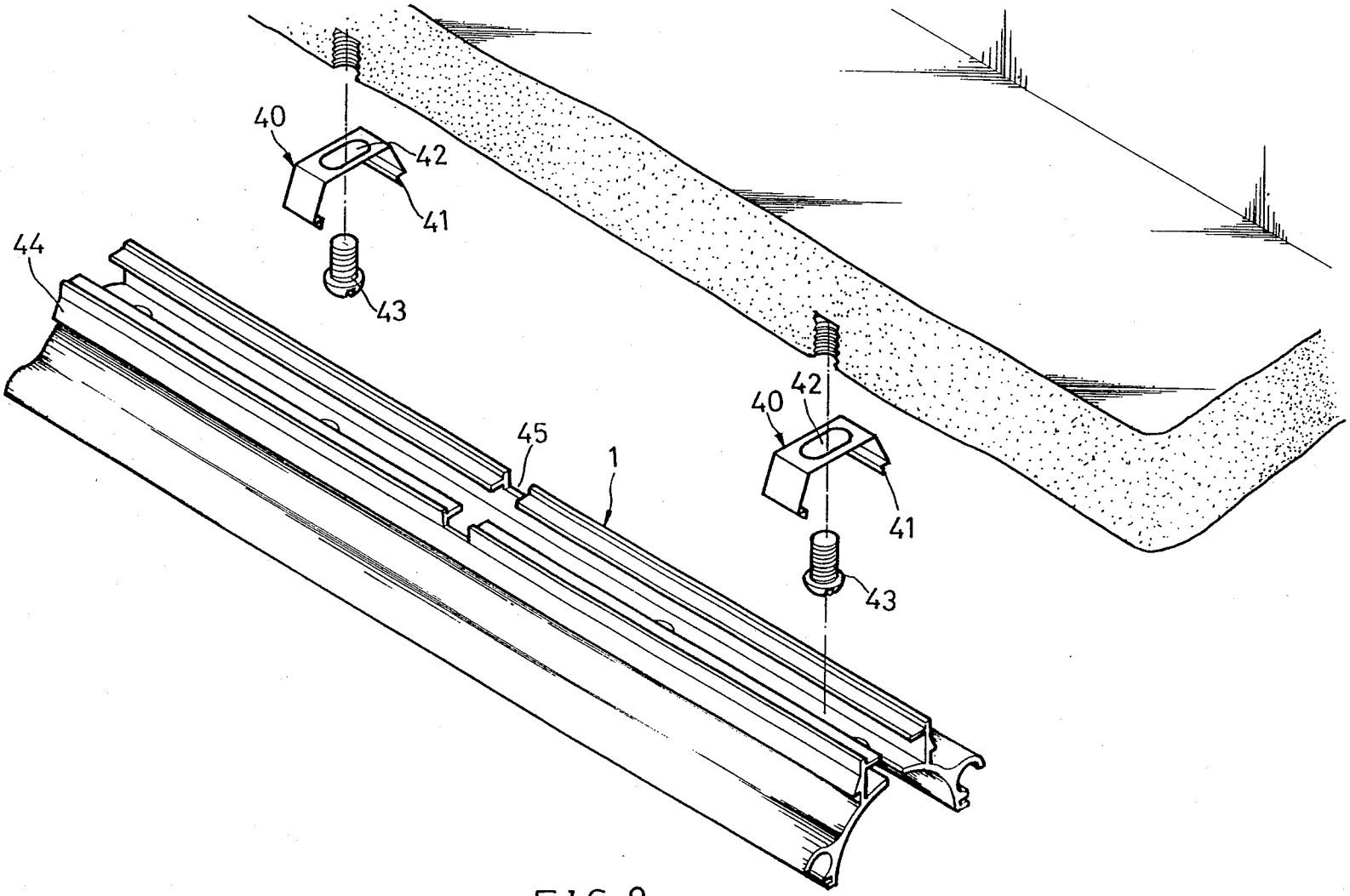
FIG. 8 is a perspective view of the body of lamp device of the second preferred embodiment.
Figure 8A:
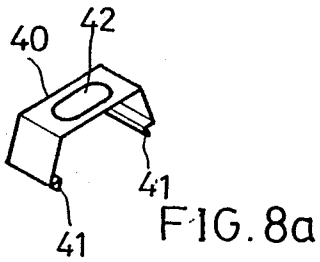

Please refer to the perspective view of the clamp for the second preferred embodiment as shown in FIG. 8 and 8*a*, the clamp 40 is a "Π" shaped spring leaf, comprising inferiorly a hook plate 41 and superiorly a bolt hole 42 for adjustment of location wherein the clamp 40 is fixed to ceiling by means of a bolt 43 screwing up through the bolt hole 42. When the clamp is fixed onto ceiling, the lamp device can be attached thereto in a way that the hook-shaped flange 44 of the groove 2 of lamp device body 1 is pushed in the hok plate 41 of the clamp 40, the clamp 40 is then propped to open, as soon as the external convex of each hook-shaped flange 44 passes through the internal convex of each hook plate 41 of the clamp 40, the opened clamp 40 will soon return to original position to locate the hook-shaped flange 44 of the body at the ceiling. To detach the fixed lamp device from the ceiling, one needs only to prop each hook plate 41 of the clamp 40 to open, by a flat screw driver, letting the hook-shaped flange 44 get out of the clamp 40, and the lamp device body can be easily taken down.

Figure 8B:
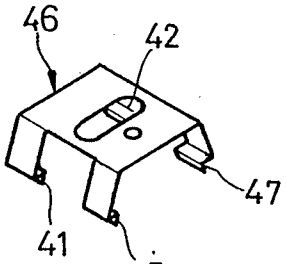

Please refer to the perspective view of the clamp for the second preferred embodiment, which strides over two lamp device bodies, as shown in FIG. 8*b*, the crossclamp 46 comprises two pairs of hook plate 47. When one wishes to connect several pieces of lamp device bodies 1 together, firstly fix a crossclamp 46 on the contact point and the bilateral end points of each lamp device body with screw and apply the same process as described in FIG. 9*a* for installation and for detachment in a way to let one pair of hook plates 47 of the crossclamp 46 fasten on a lamp device body 1 at same side and to let the other pair of hook plates 47 of the crossclamp 46 fasten on another lamp device body 1 at the othe side. By means of this process, several lamp devices can be easily connected together.

Please refer to the perspective view of the third preferred embodiment for the present invention as shown in FIG. 9.

The installation is to conceal the upper part of the lamp device body 1 inside the ceiling. The structure of the lamp device body 1 for this preferred embodiment is similar to those described before, with an exception of two pair of symmetrical round holes 52 drilled bilaterally.

Please refer to the clamping device for the third preferred embodiment as shown in FIG. 9*a*, the clamping device 48 has a steel plate 49 welded at the middle depressed part to form a slide way 53 which can just match with the groove 2 of the lamp device body 1.

Please refer to the cross-sectional view of the line A-A of the third preferred embodiment when fixed to ceiling as shown in FIG. 10. When installing, firstly prop the clamping device 48 to open, letting the slide way 53 slide into the groove 2 of the lamp device body 1 and be fixed at the location of the round holes 52. At the time, the edge end 50 of the clamping device 48 is deeply positioned at the inner part of the lamp device body 1. As soon as the clamping device 48 is fixed to the lamp device body 1, it can be pushed inside the ceiling through the pre-arranged open channel of the ceiling. When the hook flanges 51 of the both ends of the clamping device 48 have not fully passed through the ceiling, the ceiling will bilaterally squeeze both hook flanges 51 of the clamping device 48 to bend inward so as to let them pass through. As soon as the convex part of each hook flange 51 has passed through the ceiling, the clamping device 48 immediately returns to original position and the end part of the hook flange 51 spontaneously strides over the ceiling as shown in the drawing of line A—A and will not drop down from the ceiling.

Figure 10A:
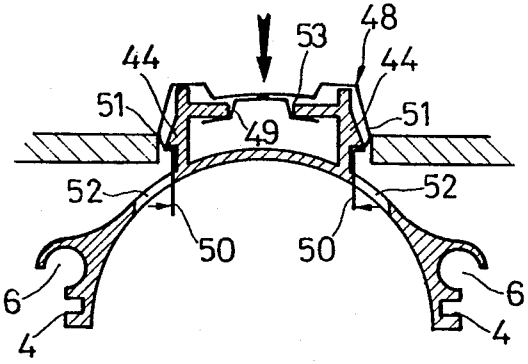

Please refer to FIG. 10*a* regarding the dismounting of the third preferred embodiment. Use a pointed hand vice or other device to clamp on the both edge ends 50 of the clamping device 48 by force, the bilateral hook flanges 51 will be squeezed to bend inward and the clamping device 48 will be easily taken down.

The examples of the preferred embodiments described above are for easy understanding of the features of the structure for the present invention. As previously described, the present invention is simple in structure which requires less accessary, is easy for production in normalization, can drastically reduce manufacturing cost and can absolutely improve the dazzling problem happened in conventional lamp devices.

What is claimed is:

1. A substantially linear fluorescent lamp device comprising:

a lamp body, said body defining, when considered in cross section, a channel of semi-circular configuration, with the interior concave wall thereof including a glossy surface to enhance the reflective properties of said lamp device;

said body also having an upper exterior groove formation defined by hook-shaped flanges to reinforce said lamp body and for the concealment of respective electrical wires, a central aperture in said upper groove formation for passing therethrough respective electric wires;

said body including exteriorly at each channel wall terminus a round formation for a respective light reflecting plate; and said lamp body further including exteriorly at each channel terminus a retaining groove formation for a respective glare-proof plate;

said round formation and said retaining groove formation extending substantially along the full length of said lamp body;

for each end of said lamp body, a tube holder for a respective tube socket end-formation of a respective fluorescent tube, wherein at least one of said tube holders defines a holder for a respective starter;

for each round formation at least one light reflecting plate, each light reflecting plate having a longitudinal hollow cylindrical flange formation adapted to be compressibly inserted in the round formation of said lamp body; each flange formation extending substantially along the full length of a reflecting plate;

a plurality of glare-proof plates strung together along a respective soft wire, each one of said glare-proof plates having a rectangular configuration but including an upper semi-circular recess formation, and upper retaining formations adapted to interlock with the retaining groove formations of said lamp body, and a line gap for a respective soft wire, said line gap being of sufficient size for receiving exclusively said soft wire; and a soft wire secured at respectively end-wise located glare-proof plates;

wherein the lamp body and the light reflecting plates are formed by direct extrusion and which can be cut into desired lengths to match the length of the respective preselected fluorescent tube.

2. The tube holder according to claim 1, comprising a cylindrical outer sleeve, said sleeve having a slot for electric wires to extend therein, two bolt holes for respective bolts, for securement of said outer sleeve at said lamp body, and also having interiorly three peripherally distributed pin holes;

a lamp socket freely moveable disposed in said outer sleeve, said lamp socket having at least three exterior recess formations respectively matching with said three pin holes of said outer sleeve, said lamp socket on the back side having threaded holes for respective bolts for the securement of electric wires, and said lamp socket also on the back side having a depression formation for the location of a respective spring, and said lamp socket having on the front side holes for respective connection legs of a respective fluorescent tube, wherein when the connection legs of a fluorescent tube are inserted into the front holes of said lamp socket, the connection legs will contact the bolts on the back side of the lamp socket to close an electric circuit to turn on a respective fluorescent tube; and said lamp socket comprising one bolt hole each on both sides of the depression formation, and each bolt hole comprising at its outer side a retaining cutting for bare electric wire to be placed therein and being retained in place by a respective bolt;

a spring positioned within said outer sleeve to extend between said outer sleeve and said lamp socket and adapted to bias said lamp socket outwardly and into contact with the respective fluorescent tube as aforesaid; and a ring-shaped stop plate, said stop plate having three pins on its back side for matchingly insertion respectively into the three pin holes of said outer sleeve, but so as to keep the lamp socket moveable within said outer sleeve and to preclude inadvertent removal of said lamp socket.

3. The tube holder according to claim 1, wherein the other end of a preselected fluorescent tube is adapted to be attached at a starter holder fixed with two pieces of spring leaves by two pieces of bolts and then covered with a cover plate, said spring leaves being of the flat type with each end facing upward and being used as contact points to connect a respective starter.

4. The lamp device according to claim 1, wherein said glare-proof plates are strung equidistantly at respective soft wires and are hung at said retaining groove formations of said body but with substantially free movement.

5. The lamp according to claim 1, and further including holding clamps, each of said clamps having an inverted "U" shape with respective lateral hook flanges, and being made of elastic steel, comprising interiorly a respective hook-shaped plate on each end and exteriorly a longitudinal bolt hole, wherein at least one clamp can be fixed to a respective ceiling with a screw through the bolt hole, but allowing the lamp body to be attached to the clamp by means of its hook flange.

6. The lamp according to claim 5, wherein said clamp is a cross clamp adapted to extend over two adjacent located lamps, and comprising exteriorly a longitudinal bolt hole and interiorly two pairs of hook plates.

7. The lamp device according to claim 1, and further including a clamping device which includes a steel plate welded centrally at a respective depressed part to form a slide way which can be sufficiently placed inside said groove formation of the lamp body and the respective ends of said clamping device can be sufficiently deep inserted into the respective round holes of said lamp body.

* * * * *